United States Patent [19]

Muto

[11] Patent Number: 4,922,398

[45] Date of Patent: May 1, 1990

[54] AUTOMOTIVE LAMP ASSEMBLY

[75] Inventor: Masakazu Muto, Atsugi, Japan

[73] Assignee: Ichikoh Industries Limited, Tokyo, Japan

[21] Appl. No.: 175,982

[22] Filed: Mar. 31, 1988

[30] Foreign Application Priority Data

Mar. 31, 1987 [JP] Japan ..... 62-46662

[51] Int. Cl.[5] ..... F21V 7/00

[52] U.S. Cl. ..... 302/296; 362/61; 362/349; 362/346; 362/305; 313/114

[58] Field of Search ..... 362/61, 80, 226, 80, 362/346, 349, 302, 303, 341, 263, 256, 207, 296, 297, 305; 313/113, 114, 117

[56] References Cited

U.S. PATENT DOCUMENTS

| | | | |
|---|---|---|---|
| 2,088,544 | 7/1937 | Braselton | 313/113 |
| 3,835,342 | 9/1974 | Freeman | 313/114 |
| 3,896,302 | 7/1975 | Whitney | 362/341 |
| 4,268,895 | 5/1981 | Yabata | 362/341 |
| 4,423,471 | 12/1983 | Gordin et al. | 362/287 |
| 4,563,730 | 1/1986 | Soito | 362/80 |
| 4,679,127 | 7/1987 | Ernst et al. | 362/303 |

FOREIGN PATENT DOCUMENTS

| | | | |
|---|---|---|---|
| 1160871 | 3/1958 | France | 362/256 |
| 55736 | 12/1943 | Netherlands | 362/346 |
| 2022234 | 12/1979 | United Kingdom | 362/61 |

*Primary Examiner*—Ira S. Lazarus
*Assistant Examiner*—D. M. Cox
*Attorney, Agent, or Firm*—Foley & Lardner, Schwartz, Jeffery, Schwaab, Mack, Blumenthal & Evans

[57] ABSTRACT

In a light assembly in which a holder in which a bulb is fixed is replaceably mounted in a lamp housing having a reflector formed integrally therewith, the portion near the apex of the reflective surface of the reflector is formed flat, so that the reflective surface of the reflector can be formed without taking in consideration the molding precision of the portion near the apex and that any of the lamp units under different standards are applied can be accomodated. Furthermore, since the light emitted from the filament and going toward the flat portion can be prevented by a shade from being incident upon the flat portion, thus preventing any glaring light from occurring.

2 Claims, 6 Drawing Sheets

AUTOMOTIVE LAMP ASSEMBLY

BACKGROUND OF THE INVENTION (a) Field of the Invention

The present invention relates to a light assembly having a bulb holder is replaceably mountable in a housing with which a reflector is formed integrally.

(b) Description of the Prior Art

Generally, the automotive light assembly comprises a housing with which a reflector having a reflective surface like a paraboloid of revolution is formed integrally, a bulb holder mountable from outside through an opening provided near the apex of the reflective surface in such a manner that the bulb filament is positioned near the focal point of the reflective surface of the reflector, and a lens provided at the front of the housing These elements are so arranged that the light emitted from the filament in the bulb is projected as reflected by the reflective surface of the reflector and refracted through the lens to provide a predetermined pattern of light distribution ahead of an automobile on which the light assembly is mounted.

Even in case cars used in the USA and Europe are of a same model, the distribution pattern of light reflected ahead by the reflector of a light assembly provided on the cars is subject to one standard in the USA and to other in the Europe. That is to say, the bulb and its associated holder of automotive light assembly are to be designed and manufactured so as to meet the requirements different in the USA from in the Europe, and also the standard applicable, in the USA, to the shape of the socket of the lamp housing including the reflector in which the bulb holder is fitted is different from that in the Europe. All the applicable standards prescribe, concerning the dimensions of the lamp units of automotive light assemblies, that the filament in the bulb of any automotive light assembly should be disposed near the focal spot of the reflective surface of the reflector. Among others, the standard in the northern American countries, especially, the Federal Motor Vehicle Safety Standards (FMVSS) in the USA and the EC Standard in the Europe stipulate in detail the dimensional requirements for the lamp units of automotive light assemblies. For example, FMVSS No. 108 prescribes a lamp unit provided with a bulb classified as #9004 and in which the filament in the bulb is about 33.5 mm distant from the position where the bulb holder is set and the outside diameter of the holder inserted in the opening in the reflector is about 33.8 mm. Also, the EP Standard defines a lamp unit provided with a bulb classified as H4 and in which the distance between the bulb filament and the position where the bulb holder is set is about 26 mm and the holder inserted in the opening in the reflector is about 34.5 mm in outside diameter In case cars exported to the USA and Europe are a same model, the spaces for the light assemblies of the cars are identical, and so the housings of the light assemblies are nearly identical in outside dimensions. However, to meet the requirements in the USA and those in the Europe, respectively, one die is used to mold the lamp housings for the light assemblies employed on the cars for the USA while other die is used to mold the lamp housings for the light assemblies on the cars for the Europe. Normally, a portion, including the reflective surface of the reflector, of the lamp housing of a light assembly used in the USA is molded using a male die A1, while a socket portion, including the opening in which the bulb holder is inserted, is molded using the female die B1. A portion, including the reflective surface of the reflector, of the lamp housing of a light assembly used in the Europe is molded using a male die A2, while a socket portion, including the opening in which the bulb holder is fitted, is molded using a female die B2. Practically, however, it is not economically advantageous to use different dies for molding lamp housings of light assemblies to be provided on cars of a same model but which are to be used in different countries. Also, since the opening of the socket portion in which the bulb holder is to be inserted is formed in the curve surface near the apex of the reflective surface of the reflector during the molding of a lamp housing, it is difficult to control the die-molding parameters which have an influence on the precision of the curved surface formed near the apex of the reflective surface.

SUMMARY OF THE INVENTION

The present invention has an object to overcome the above-mentioned drawbacks of the conventional techniques by providing an automotive replaceable light assembly which can meet the different standards, applicable to the light assembly, in the different destination countries.

The present invention has another object to provide an automotive replaceable light assembly low in manufacturing costs and of which different lamp housings for different destination countries can be molded using a common male die.

The present invention has a still another object to provide an automotive replaceable light assembly of which the lamp housing can be molded with a uniform precision of the curved surface near the apex of the reflective surface of the reflector, which will not cause any glaring.

In the automotive replaceable light assembly according to the present invention, the portion near the apex of the reflective surface of the reflector is formed as a flat surface substantially perpendicular to the optical axis, and a shade substantially blocking the light projected from the filament in the bulb toward the flat surface is disposed as surrounding the bulb. The inner portion including the reflective surface of the reflector of the lamp housing is molded using a common male die having formed at the end thereof a flat portion corresponding to the aforementioned flat surface, while the socket portion including the opening in which the bulb holder is to be fitted and the outer portion of the lamp housing are molded using an independent male die for each destination country. The aforementioned flat surface is formed substantially round and its diameter depends upon the standard in a country in which the light assembly is to be used, the standard requiring for a larger outside diameter of the bulb holder inserted into the opening. Thus, the socket portion including the opening in which the holder is inserted can be molded using a female die which will provide a socket portion conforming to the standard in the destination country. Hence, the manufacturing costs of the lamp housing can be considerably reduced, and the light directed toward the flat surface is blocked by the shade so that no glaring occurs.

These and other objects and advantages of the present invention will be better understood from the ensuing description made, by way of example, of the embodiments of the present invention with reference to the drawings.

BRIEF DESCRIPTION OF THE DRAWINGS

FIGS. 1 to 5 show one embodiment of the automotive replaceable light assembly according to the present invention and which is to be provided on a car for the USA, of which;

FIG. 1 is a schematic sectional view showing the installation of the bulb holder in the lamp housing;

FIG. 2 is a plan view of the shade as viewed from the direction of arrow A in FIG. 1;

FIG. 3 is a sectional view taken along the line III—III of FIG. 2;

FIG. 4 is an explanatory drawing of the shade forming process, the portion between the two C—C lines being the development of the shade;

FIG. 5 is an explanatory drawing of the male and female dies for molding the lamp housing including the reflector;

FIGS. 6 to 10 show another embodiment in which the automotive replaceable light assembly according to the present invention is adapted for installation on a car for the Europe, of which;

FIG. 6 is a schematic sectional view showing the installation of the bulb holder in the lamp housing;

FIG. 7 is a plan view of the shade as viewed from the direction of arrow Y in FIG. 6;

FIG. 8 is a sectional view taken along the line VIII—VIII of FIG. 7;

FIG. 9 is an explanatory drawing of the shade forming process, corresponding to FIG. 4; and FIG. 10 is an explanatory drawing of the male and female dies for molding the lamp housing including the reflector.

DETAILED DESCRIPTION OF THE PREFERRED EMBODIMENTS

Figure 1:
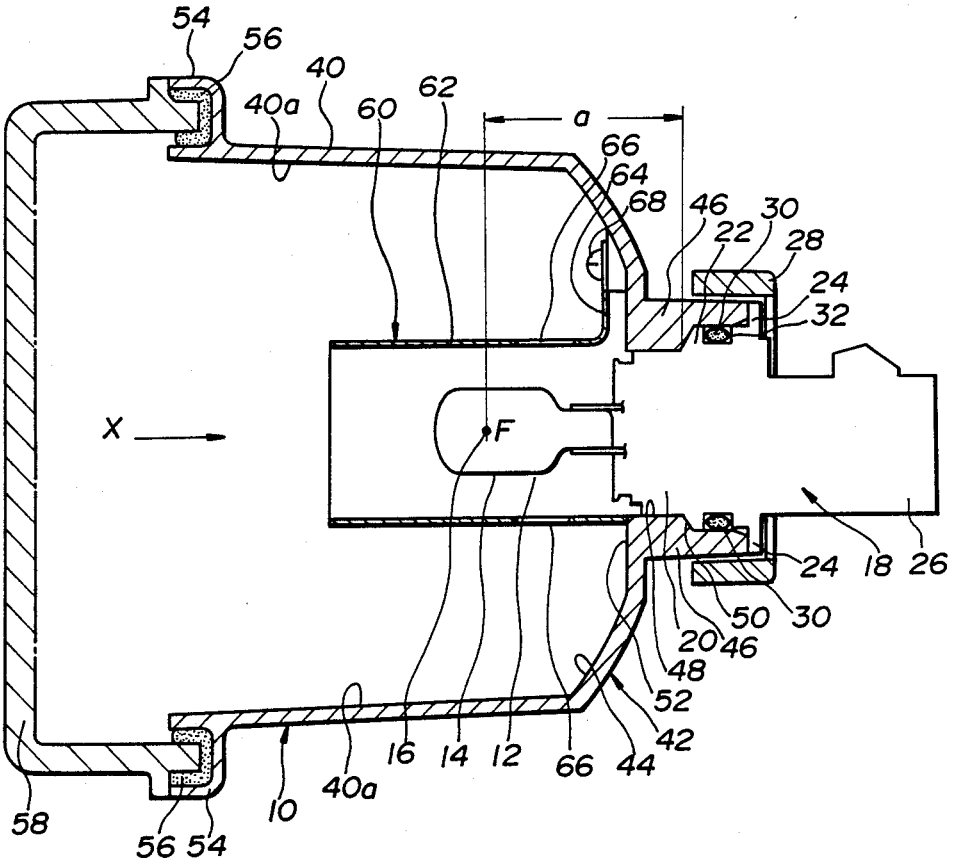
Figure 2:
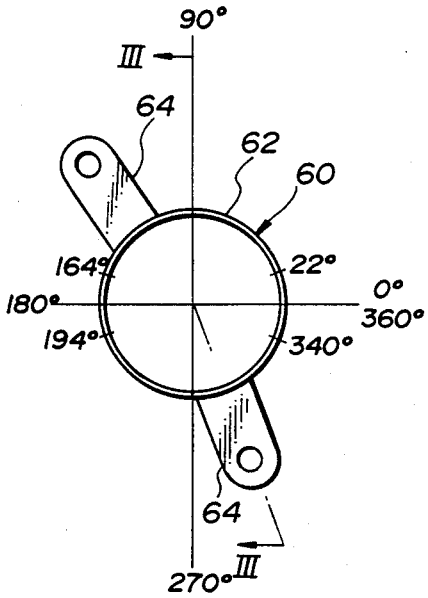
Figure 3:
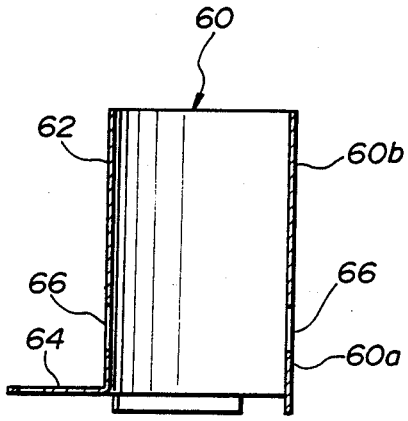
Figure 5:
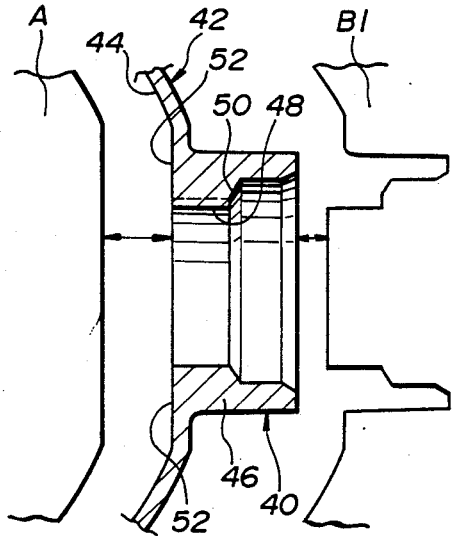
Figure 4:
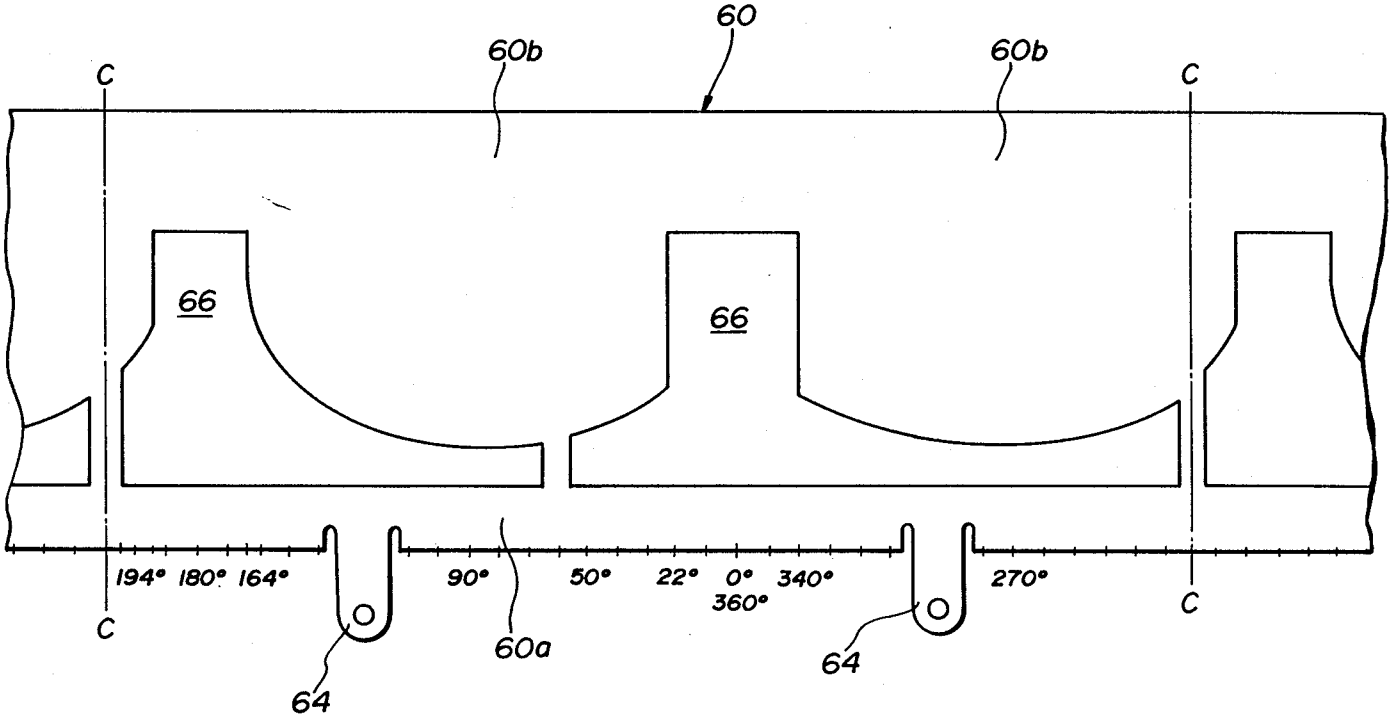
Figure 6:
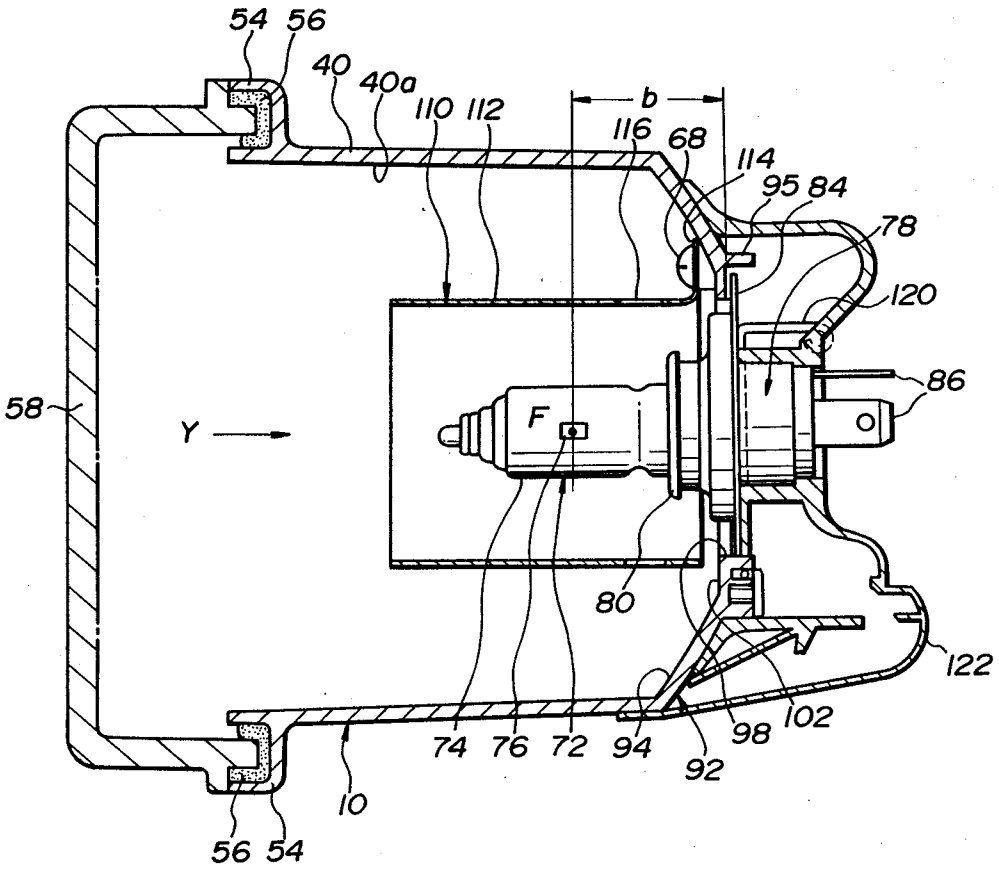

Referring now to FIG. 1, the light assembly according to the present invention, adapted for installation on a car which is to be used in the USA, is shown as a whole with a reference numeral 10. The light assembly 10 has a lamp unit 12 comprising a bulb 14 specified as #9004 in the FMVSS and a holder 18 in which the bulb 14 is fixed. The bulb 14 has a filament 16 disposed nearly perpendicularly to the optical axis included in a horizontal plane, and also the bulb 14 is supported in a base 20 fixed in the holder 18. As seen, the lamp unit 12 is schematically shown, not as any sectional view. The bulb 14 is disposed in the lamp house defined by a lamp housing 40 and a lens 58 covering the front opening of the lamp housing 40. The light emitted from the filament 16 is reflected by a reflective surface 44 of a reflector 42 formed integrally with, and as a part of, the lamp housing 40, and projected ahead through the lens 58. The lens 58 is fixed with an adhesive 56 to a circular groove 54 formed in the circumferential rim of the front opening of the lamp housing 40. The lamp unit 12 is replaceably positioned within an opening 48 in a socket portion 46 formed at the back of the reflector 42 forming a part of the lamp housing 40. That is to say, the holder 18 having a shoulder 22, flange 24 and connector 26 is, when inserted from outside into the opening 48 at the back of the reflector 42, engaged on a step portion 50 formed inside the socket 46, and the flange 24 of the holder 18 is engaged on the outer end of the socket 46. The reference numeral 30 indicates an O-ring disposed in a recess 32 formed in the outer circumference of the holder 18. As it has the flange 24 thereof forced onto the outer end of the socket 46 by means of a cap 28, the holder 18 inserted from outside into the opening 48 at the back of the reflector 42 is positioned with respect to the lamp housing 40. When the holder 18 takes this position, the filament 16 is set at the position of the focal spot F of the reflector 42, so that the distance a from the filament 16 to the end of the shoulder 22 that is nearer to the base 20 is about 33.5 mm which conforms to the requirement stipulated in the FMVSS, and the position of the shoulder 22 is determined depending upon the shape, namely, the position of the focal spot F, of the reflective surface 44 of the reflector 42. The shape of the reflective surface 44 of the reflector 42 is a paraboloid of revolution, that is, it is the same as that of the reflective surface of the reflector formed integrally with the lamp housing of a light assembly which is to be installed on a car for the Europe, as will be described later. A circular flat portion 52 generally perpendicular to the optical axis is formed near the apex of the reflective surface 44 of the reflector, namely, around the rear opening 48 in which the holder 18 is inserted This flat portion 52 is located at a portion which otherwise is to be formed as curved surface near the apex of the reflective surface 44. For the reason that when molding the reflective surface of the reflector, the curved surface near the apex cannot be molded into a predetermined geometric form unless the molding parameters are strictly controlled or for any similar reasons, the flat portion 52 is positively provided and a shape 60 to block the light emitted from the filament and directed toward the flat portion 52 is disposed around the bulb 14 above the flat portion 52. The shade 60 is shaped in the form of a hollow cylinder as shown in FIGS. 2 and 3, and has feet 64 disposed nearly diametrically to each other and which are fixed to the inner face of the reflector 42 each with a screw 68. As seen from the development in FIG. 4, there are provided on the circumference 62 of the shade 60 a first shade portion **60*a* to block the light emitted from the filament 16 and going toward the flat portion 52, a window portion 66 to pass the light emitted from the filament 16 and going toward the reflective surface 44 and a second shade portion 60*b* to block the light emitted from the filament 16 and going toward the inner face 40*a* of the lamp housing 40. The first shade portion 60*a* comprises a portion at a predetermined distance from the lower end of the shade 60 and prevents the light from being incident upon the circular flat portion 52. The window portion 66 has a geometrical shape as shown in FIG. 4. It is radially cut largely at the generally diametrical position while it is so cut at opposite sides of the diametrical position as to be gradually reduced in width. Since the shade 60 is so formed as to block the light emitted from the filament 16 and going toward the inner face 40*a* and the flat portion 52, respectively, of the lamp housing 40, while passing only the light emitted from the filament 16 and going toward the reflective surface 44, only the light nearly parallel to the optical axis is incident upon the lens 58. It means that the construction of the light assembly according to the present invention permits to prevent any glaring light from occurring irrespectively of the flat portion 52 provided at a part of the reflective surface. The diameter and height of the shade 60 are determined by the size of the bulb 14, distance from the filament 16 to the flat portion 52, the shape of the inner face of the lamp housing 40, etc. while the shape and size of the window portion 66 are determined by the orientation of the filament 16, geometrical shape of the reflective surface 44, size and shape of the flat portion 52, etc. As shown in FIG. 5, the lamp housing 40 having been described in the above is molded using a male die A and a female die B1. The male die A defines the shape of the inner face of the lamp housing 40 including the inner face of the reflector 42, while the female die B1 defines the shapes of the opening 48 and socket portion 46 of the reflector 42. More particularly, the shapes of the opening 48 and socket portion 46 of the reflector 42**, formed by the female die B1, are in compliance with the requirements prescribed in #9004 of the FMVSS.

Figure 7:
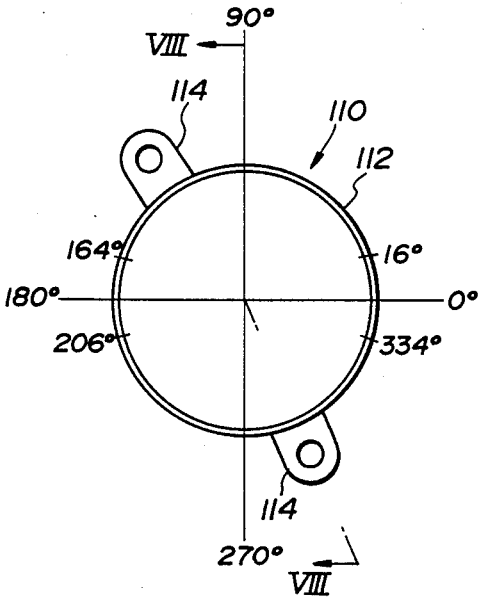
Figure 8:
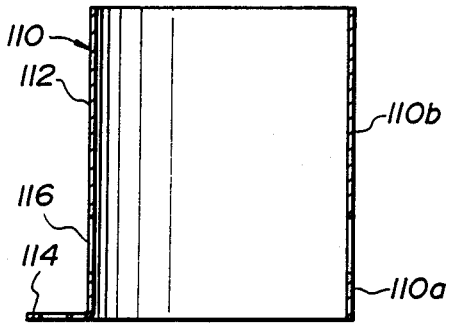
Figure 10:
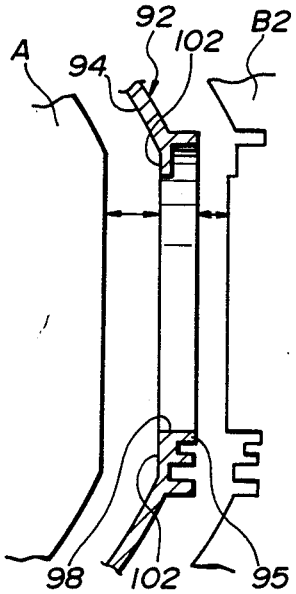

FIGS. 6 to 10 show a second embodiment of the light assembly according to the present invention that is applied to a light assembly which is to be mounted on a car for the Europe. In Figures, the same reference numbers as those in FIGS. 1 to 5 indicate the elements corresponding to those in FIGS. 1 to 5. The lamp unit 72 includes a bulb 74 prescribed in H4 of the EC standard, and an insulative-made holder 78 in which the bulb 74 is fixed. The bulb 74 has filament 76 extending in the direction of optical axis and is supported in a base portion 80 secured in the holder 78. The holder 78 has formed thereon a flange portion 84 and fixed at the end thereof a terminal which is to be connected to any external power supply. In this embodiment, the portion corresponding to the socket portion in the first embodiment is a rear wall 95 formed on the back of the reflector 92. With the flange portion 84 of the holder 78 forced to the rear wall 95 of the reflector 92 by means of a spring 120, the holder 78 is fixed to the lamp housing 40. In this condition, the center of the filament 76 is positioned at the focal point F of the reflector 92, and the distance b from the center of the filament 76 to the flange portion 84 is about 26 mm which meets the requirement in the EC standard. The reflective surface 94 of the reflector 92 has a same shape as the reflective surface 44 of the reflector 42 in the first embodiment having been previously described, and the flat portion 102 has a same diameter as the flat portion 52. Since the area, namely, the diameter, of the rear opening 98 must be larger than the rear opening 48 in the first embodiment in order to meet the requirement in the EC standard, the area of the flat portion 102 is smaller than that of the flat portion 52 in the first embodiment. The lamp housing 40 including the reflector 92 is molded using the male die A used in the first embodiment and a female die B2 which complies with the EC standard. The flat portion 102 formed around the aforementioned rear opening 98 has disposed thereon around the bulb 74 a hollow cylindrical shade 110 as shown in FIGS. 7 and 8. The shade 110 is fixed to the inner face of the reflector 92 with a screw 68. As seen from the development in FIG. 10, the circumference 112 of the shade 110 consists of a first shade portion 110*a* to block the light emitted from the filament 76 and going toward the reflective surface 44, a window portion 116 to pass the light emitted from the filament 76 and going toward the reflective surface 44, and a second shade portion 110*b* to block the light emitted from the filament 76 and going toward the inner face 40*a* of the lamp housing 40. The first shade portion 110*a* is formed by a portion at a predetermined distance from the lower end of the shade 110 and prevents the light emitted from the filament 76 from being incident upon the circular flat portion 102. The window portion 116 has a geometrical shape shown in FIG. 10. It is radially cut largely at the generally diametrical position while it is so cut at opposite sides of the diametrical position as to be gradually reduced in width. Since the shade 110 is so formed as to block the light emitted from the filament 76 and going toward the inner face 40*a* and the flat portion 102, respectively, of the lamp housing 40, while passing only the light emitted from the filament 16 and going toward the reflective surface 94, only the light nearly parallel to the optical axis is incident upon the lens 58.

Figure 9:
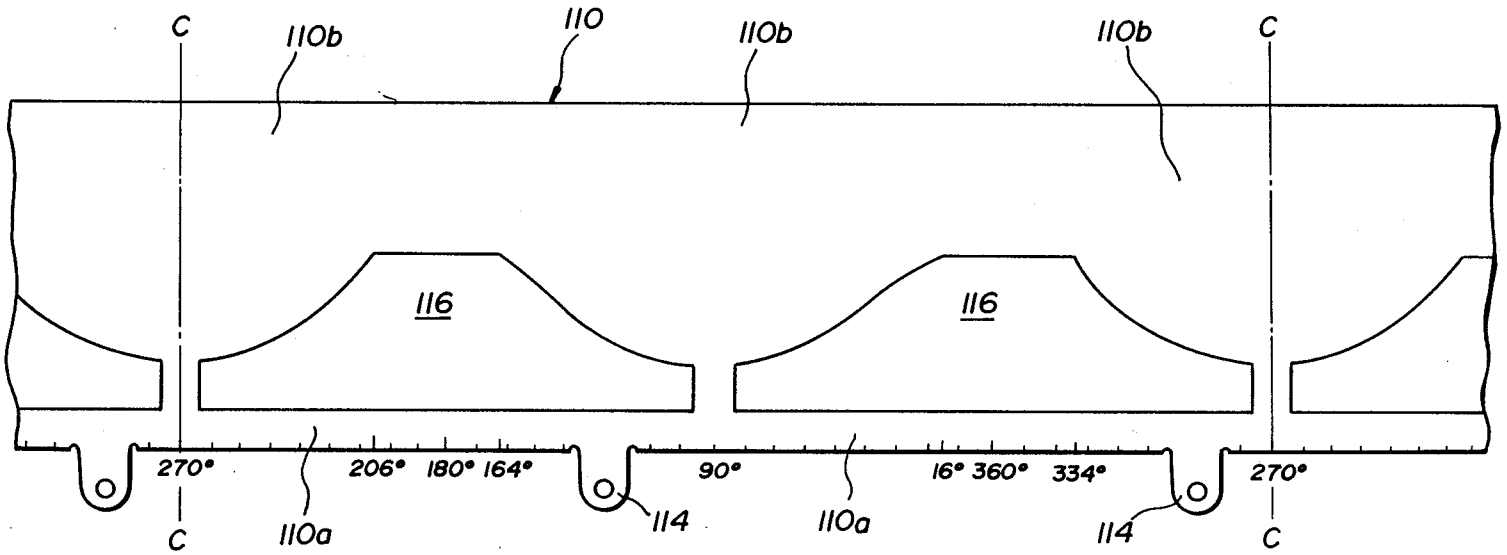

In the aforementioned two embodiments of the present invention, each of the shades 60 and 110 has formed therein the windows and feet by punching a single elongated metal sheet as shown in FIGS. 4 and 9, and the portion cut along the C—C lines at two places is a development of one shade. The metal sheet thus cut is rounded to form a cylinder and the sheet ends are joined to each other by seam welding or any other appropriate method, and further the feet are bent outwardly about 90 degrees. In this way, each of the shades 60 and 110 is formed.

As having been described in the foregoing, in the light assemblies according to the present invention, the reflective surfaces 44 and 94 of the reflectors 42 and 92, respectively, have a same geometrical shape, the core sides of the lamp housings of the light assemblies for the USA and EC are molded using a common male die A so that the portions near the apexes are positively formed into the flat portions 52 and 102, respectively, of a same diameter, the cavity sides including the rear opening 48 in which the holder 18 to be mounted in the lamp housing, smaller in outside diameter, of the light assembly for the EC is molded using a female die B2, and the diameters of the flat portions 52 and 102 are so selected correspondingly to the inside diameter of the rear opening 98 that the larger rear opening 98 can be formed. The shade 60 (110) to block the light emitted from the filament 16 (76) and going toward the flat portion 52 (102) is disposed to accommodate any of the lamp units conforming to different standards and to prevent any glaring light from occurring. Therefore, the light assembly according to the present invention can be manufactured with reduced costs.

What is claimed is:

1. A replaceable light assembly comprising:

a lamp housing having a reflector having a curved surface with an apex formed integrally therewith;

a lamp unit provided with a lamp holder and a lamp bulb attached to said lamp holder, which is inserted through an opening formed at a portion including the apex of said reflector so that a filament of said lamp bulb is positioned near a focal spot of a reflective surface of said reflector;

a portion of said reflective surface around said opening being positively formed as a flat surface contiguous to said curved surface and substantially perpendicular to the optical axis of said reflector and having a given area; and a shade provided in relation to the area of said flat surface for preventing the light emitted from said filament from being incident upon said flat surface and for directing the light emitted from said filament toward other portions of said reflective surface, whereby the reflector can accommodate differently sized lamp units.

2. A replaceable light assembly comprising:

a lamp housing having a reflector having a curved surface with an apex formed integrally therewith;

a lamp unit provided with a lamp holder and a lamp bulb attached to said lamp holder, which is inserted through an opening formed at a portion including the apex of said reflector so that a filament of said lamp bulb is positioned near a focal spot of a reflective surface of said reflector;

means, including a portion of said reflective surface around said opening positively formed as a flat surface contiguous to said curved surface and substantially perpendicular to the optical axis of said reflector, for providing a flat surface area having a sufficient size to permit formation therein of an opening of selected diameter to accommodate one of differently sized lamp units; and a shade provided in relation to the area of said flat surface for preventing the light emitted from said filament from being incident upon said flat surface and for directing the light emitted from said filament toward other portions of said reflective surface.

* * * * *